US005089096A

United States Patent [19]

Rijkhof et al.

[11] Patent Number: 5,089,096

[45] Date of Patent: Feb. 18, 1992

[54] PREPARATION OF QUATERNARY AMMONIUM HYDROXIDES

[75] Inventors: Evert J. Rijkhof, Soest; Johannes P. P. Tholen, Bussum; Hendricus J. H. Van Der Maas, Hedel; Gosse Boxhoorn, Tricht, all of Netherlands

[73] Assignee: Shell Research Limited, United Kingdom

[21] Appl. No.: 575,902

[22] Filed: Aug. 31, 1990

[30] Foreign Application Priority Data

Aug. 31, 1989 [GB] United Kingdom ..... 8919682

[51] Int. Cl.[5] ..... C25B 1/00

[52] U.S. Cl. ..... 204/102

[58] Field of Search ..... 204/102, 128

[56] References Cited

U.S. PATENT DOCUMENTS 2,363,387 11/1944 Bock ..... 204/72
4,578,161 3/1986 Buonomo et al. ..... 204/102
4,714,530 12/1987 Hale et al. ..... 204/131

FOREIGN PATENT DOCUMENTS 0181385 11/1982 Japan ..... 204/102

OTHER PUBLICATIONS

English language abstract of Japanese 57-155390.
English language abstract of Japanese 57-181385.
English language abstract of Japanese 59-193287.
English language abstract of Japanese 59-193288.
English language abstract of Japanese 59-193289.
English language abstract of Japaneses 60-131985.
English language abstract of Japanese 60-131986.
English language abstract of Japanese 61-190085.
English language abstract of Japanese 62-139890.

*Primary Examiner*—John Niebling
*Assistant Examiner*—Steven P. Marquis

[57] ABSTRACT

A process for the preparation of a quanternary ammonium hydroxide, which comprises electrolyzing a quaternary ammonium halide in a divided electrolysis cell wherein the anode material is selected from iron, nickel, zinc, molybdenum and manganese, and an electrolysis cell specifically adapted for use in the process.

15 Claims, No Drawings

PREPARATION OF QUATERNARY AMMONIUM HYDROXIDES

This invention relates to an electrolytic process for the preparation of quaternary ammonium hydroxides, and to an electrolytic cell specifically designed for carrying out the process.

Quaternary ammonium hydroxides have a wide variety of industrial applications. For example, they are used as templates in the preparation of zeolite catalysts, and as cleaning agents for electronic circuits. It is a common requirement for such applications that the quaternary ammonium hydroxides used should not contain more than trace quantities of metal salt impurities, and it is also necessary for certain uses, e.g. as cleaning agents for electronic circuits, for the quaternary ammonium hydroxides to contain no more than trace quantities of halide ions.

It is well known that quaternary ammonium hydroxides of high purity may be prepared from corresponding quaternary ammonium salts by electrolysis in a divided electrolysis cell. Examples of such processes may be found in U.S. Pat. Nos. 3,402,115, 4,394,226, 4,572,769 and 5,634,509, and European patent applications publication numbers 127201 and 255756.

In each of these known processes, the electrolysis cell is divided into compartments by one or more ion-exchange membranes each of which is selectively permeable either to cations or anions. At the start of the processes, an aqueous solution of the quaternary ammonium salt is introduced into one of the compartments, and an aqueous medium into each of the remainder. An electrical current is then passed through the cell. This causes quaternary ammonium ions to be drawn towards the cathode, and the counterions from the salt to be drawn towards the anode. As a result, the quaternary ammonium ions and their counterions become separated into different compartments, and an aqueous solution of quaternary ammonium hydroxide is obtained.

The quaternary ammonium salts most readily available for electrolysis are the halides. However, when the halides are subjected to electrolysis, halide ions present in the anode compartment of the electrolysis cell are converted into hypohalite ions. Hypohalite ions are powerful oxidising agents which, once formed in the electrolysis cell, will attack and damage the expensive ion-exchange membranes dividing the cell.

Surprisingly, an electrolytic process has now been found which enables quaternary ammonium hydroxides to be prepared from quaternary ammonium halides without the formation of hypohalite ions.

Accordingly, the present invention provides a process for the preparation of a quaternary ammonium hydroxide, which comprises electrolysing a quaternary ammonium halide in an electrolysis cell divided by at least an anion-exchange membrane, wherein the anode material is selected from iron, nickel, zinc, molybdenum and manganese.

In the process according to the invention, the material of the anode is oxidised instead of the halide ions. As a result, a solution of a metal halide is formed in the anode compartment. Unlike hypohalite solution, this solution is harmless to ion-exchange membranes.

Preferably the anode material is iron. An iron halide solution can readily and safely be disposed of since iron (unlike other transition metals) is non-toxic.

Preferably the quaternary ammonium halide is a quaternary alkyl ammonium halide, especially a quaternary $C_{1-4}$ alkyl ammonium halide. The alkyl groups are preferably the same and are each methyl, ethyl, n-propyl or n-butyl. The halide may be fluoride, chloride, bromide or iodide. Preferably it is chloride or bromide.

As has been previously mentioned, for many of their applications, quaternary ammonium hydroxides should contain no more than trace quantities of metal salts. In the process according to the invention, metal cations formed at the anode are kept apart from the quaternary ammonium cations by an anion-exchange membrane placed between the anode and the quaternary ammonium cations.

Metal cations may additionally be kept out of the compartment containing the produced quaternary ammonium hydroxide (usually the cathode compartment) by maintaining the pH in that compartment above 11, preferably above 14. In this way, the metal cations are precipitated onto the surface of the ion-exchange membrane separating the adjacent compartments. Quaternary ammonium hydroxides are themselves strongly basic, and hence the pH may be adjusted at the start of the electrolysis by adding some quaternary ammonium hydroxide. Alternatively, but not preferably, ammonium hydroxide may be used as the base. It may be removed at the end of the process by evaporation. The pH in each of the remaining compartments of the electrolysis cell is preferably maintained below 5, for example by adding aqueous hydrohalic acid.

The electrolysis cell used in the process according to the invention is preferably divided by at least one anion-exchange membrane and at least one cation-exchange membrane. For example, the cell may be divided into three compartments by one anion-exchange membrane and one cation-exchange membrane.

When an anion-exchange membrane is used in the process according to the invention, it may be any of the anion-exchange membranes known for use in the electrolysis of quaternary ammonium salts.

Specific examples of suitable anion-exchange membranes include NEOSEPTA AF4/P (Trade Mark, Tokuyama Soda Co., No.4-5, 1-Chome, Nishi-Shimbashi, Minato-ku, Tokyo, Japan).

When a cation-exchange membrane is used in the process according to the invention, it may be any of the cation-exchange membranes known for use in the electrolysis of quaternary ammonium salts. Typically, suitable cation-exchange membranes are synthetic polymers such as a polymeric fluorocarbon, polystyrene or polypropylene having cationic exchange groups such as carboxylate groups or sulphonate groups. Specific examples of suitable cation-exchange membranes include NAFION 324 and NAFION 430 (Trade Marks, Du Pont de Nemours, Wilmington, USA).

The cathode used in the process according to the invention may be made of any of the materials known to be suitable for use as a cathode in the electrolysis of quaternary ammonium halides. Examples of suitable materials are stainless steel, nickel, platinum, graphite, iron and ruthenium-coated titanium.

The electrodes in the electrolysis cell may conveniently be configured as standard plates in parallel.

The process according to the invention is conveniently effected at a temperature in the range of from 20° to 130° C., depending on the nature of the quaternary ammonium ion and the solvent used. For example considering quaternary alkyl ammonium halides, where a tetrapropylammonium halide is used, then any process temperature over the whole range may be employed, preferably in the range of from 40° to 60° C. For a tetramethylammonium halide a process temperature in the range of from 20° to 50° C., preferably in the range of from 30° to 45° C., is normally required.

The electrolysis is effected by passing a direct current through the electrolysis cell. Typically the potential difference across the cell is in the range of from 2 to 20 volts, preferably no more than 10 volts. The current density is conveniently in the range of from 0.25 to 10 A $dm^{-2}$, more preferably in the range of from 1 to 5 A $dm^{-2}$.

The procedure for charging the electrolysis cell prior to use depends upon the type(s) of ion exchange membrane selected and the number of compartments into which the cell is divided. In general an aqueous solution of a salt of the anode metal, using for example a metal chloride, is charged to the anode compartment. The concentration of metal salt in the anode compartment is conveniently in the range of from 1 to 200 g/kg.

In relation to the anion-exchange membrane, the quaternary ammonium halide is preferably charged to a compartment on the cathode side of the membrane. Halide ions will then pass through the membrane towards the anode when current is passed through the cell.

If, in addition to an anion-exchange membrane, a cation-exchange membrane is used, the cation-exchange membrane is preferably placed between the cathode and the anion-exchange membrane. The quaternary ammonium halide is then charged to the middle compartment of the cell, between the two membranes. Quaternary ammonium ions will then pass through the cation-exchange membrane to the cathode compartment, and halide ions through the anion-exchange membrane to the anode compartment, when current is passed through the cell.

It will be appreciated that the quaternary ammonium hydroxide should preferably not be charged to the anode compartment of the electrolysis cell, since this would result in the quaternary ammonium ions becoming mixed with the metal cations.

The quaternary ammonium halide is charged to the appropriate compartment of the electrolysis cell as an aqueous solution, typically at a concentration in the range of from 1 to 700 g/kg, preferably 50 to 300 g/kg.

Any compartments of the electrolysis cell which are not charged with either an aqueous solution of a salt of a metal or quaternary ammonium halide should preferably be charged with a dilute solution of quaternary ammonium hydroxide. The quaternary ammonium hydroxide acts as an electrolyte, and so ensures that an electrical current can pass through the compartment. The quaternary ammonium hydroxide is preferably present in a concentration in the range of from 10 to 400 g/kg, more preferably 100 to 350 g/kg.

The aqueous media used in the compartments of the electrolysis cell are preferably all water. However, mixtures of water and water-miscible organic solvents, for example alcohols such as methanol and ethanol, may be used.

The process according to the invention may be operated batchwise or continuously. During continuous operation, aqueous solutions are circulated continuously through the appropriate compartments of the electrolysis cell.

According to another aspect, the invention provides a divided electrolysis cell suitable for use in the process described hereinabove, which comprises at least one anion-exchange membrane, at least one cation-exchange membrane, an inert cathode and an anode selected from iron, nickel, zinc, molybdenum and manganese.

Although the process according to the invention affords quaternary ammonium hydroxides in high purity, the purity of the product may be improved still further, if desired, by subjecting it to a second electrolysis. This second electrolysis is conveniently effected using a conventional electrolysis cell with inert electrodes and a cation-exchange membrane.

The following Examples illustrate the invention.

EXAMPLE 1

A divided electrolysis cell comprising an anode compartment (12.51), a middle compartment (12.51) and a cathode compartment (12.51) was assembled. The middle compartment was divided from the anode compartment by an anion-exchange membrane (NEOSEPTA AF4/P, Trade Mark) (4.4 $dm^2$), and from the cathode compartment by a cation-exchange membrane (NAFION 324, Trade Mark) (4.4 $dm^2$). The anode consisted of iron (0.14 $m^2$) and the cathode of stainless steel (0.17 $m^2$).

A solution of ferrous chloride in water (10 g/kg) was circulated through the anode compartment, a solution of tetramethylammonium chloride in water (200 g/kg) was circulated through the middle compartment, and a solution of tetramethylammonium hydroxide in water (starting concentration 8.69 g/kg) was circulated through the cathode compartment. The pH in the anode compartment was adjusted to 3.2 by the addition of 1 M hydrochloric acid.

The temperature was then raised to 30° C., and a direct current of 10 amps passed through the cell, with a starting potential of 11.5 volts. The progress of the electrolysis was monitored periodically. The results are given in Table 1.

EXAMPLE 2

The method of Example 1 was repeated, but using zinc as the anode in place of iron. The results are given in Table 2. It was observed that the zinc anode began to dissolve in the acidic anolyte before any current was passed. During the electrolysis, a white precipitate formed in the middle compartment, leading to a higher resistance to direct current.

EXAMPLE 3

A divided electrolysis cell comprising an anode compartment (12.51), a middle compartment (28 l) and a cathode compartment (12.51) was assembled. The middle compartment was divided from the anode compartment by an anion-exchange membrane (NEOSEPTA AF4/P, Trade Mark) (4.4 $dm^2$), and from the cathode compartment by a cation-exchange membrane (NAFION 324, Trade Mark) (4.4 $dm^2$). The anode consisted of iron (0.14$m^2$) and the cathode of stainless steel (0.17 $m^2$).

For starting the cell, hydrochloric acid (75 g, 5 M aqueous solution) was added to the anode compartment and tetramethylammonium hydroxide (100 ml of 25% w/w aqueous solution) was added to the cathode compartment to initiate a flow of current across the cell.

A solution of ferrous chloride in water (10 g/kg) was circulated through the anode compartment, a solution of tetrapropylammonium bromide in water (200 g/kg) was circulated through the middle compartment, and a solution of tetrapropylammonium hydroxide in water (starting concentration 8.69 g/kg) was circulated through the cathode compartment. The pH in the anode compartment was adjusted to 3.8 to 4 by the addition of 1 M hydrochloric acid.

The temperature was then raised to 50° C., and a direct current of 9 amps passed through the cell, with a starting potential of 15 volts. The progress of the electrolysis was monitored periodically. The results are given in Table 3.

COMPARATIVE EXAMPLE 1

The method of Example 1 was repeated, but using copper as the anode in place of iron. The results are given in Table 4. It was observed that chlorine gas was produced as current was passed.

It will be appreciated by those skilled in the art that this chlorine gas will react with water to produce hypochlorite ion.

COMPARATIVE EXAMPLE 2

The general method of Example 1 was repeated to study the electrolysis of tetraethylammonium bromide, but using platinum as the anode in place of iron. The results are given in Table 5. It was observed that chlorine gas was produced as current was passed.

TABLE 1

Electrolysis of Tetramethylammonium chloride using an iron anode

| Time (hours) | Current (Amps) | Ampere hours | Temperature (°C.) | Cathode Compartment 1 TMAOH (% w/w) | Cathode Compartment $Cl^-$ (mg/l) | Cathode Compartment $Fe^{2+}$ (mg/l) | 2 Anode compartment $OCl^-$ (mg/l) | cumulative efficiency (%) |
|---|---|---|---|---|---|---|---|---|
| 0 | 10 | 0 | 35.4 | 0.86 | — | — | — | — |
| 11 | 12.5 | 114 | 36.0 | 2.08 | — | — | — | 90 |
| 24 | 12 | 270 | 36.0 | 2.8 | — | — | — | 60 |
| 28 | 12 | 318 | 37.2 | 3.27 | — | — | — | 64 |
| 39 | 16 | 458 | 36.5 | 4.37 | — | — | — | 64 |
| 76 | 16 | 1066 | 33.0 | 8.15 | — | — | — | 57 |
| 83 | 16 | 1178 | 20.8 | 8.8 | — | — | — | 56 |
| 88 | 13.5 | 1252 | 34.2 | 9.3 | — | — | — | 57 |
| 100 | 13.5 | 1414 | 34.0 | 10.5 | — | — | — | 57 |
| 118 | 14 | 1663 | 34.2 | 12.3 | <5 mg/l | <5 mg/l | <5 mg/l | 58 |

1 TMAOH = tetramethylammonium hydroxide

2 No evolution of chlorine gas was observed.

TABLE 2

Electrolysis of Tetramethylammonium chloride using a zinc anode

| Time (hours) | Current (Amps) | Ampere hours | Voltage (volts) | Temperature (°C.) | Cathode Compartment 1 TMAOH (% w/w) | Cathode Compartment $Cl^-$ (mg/l) | 2 Anode compartment $OCl^-$ (mg/l) | cumulative 1 TMAOH production (g) | cumulative efficiency (%) |
|---|---|---|---|---|---|---|---|---|---|
| 0 | 0.8 | 0 | >20 | 19.5 | 2.0 | 2 | — | 0 | — |
| | 1.2 | 18 | 8.5 | 26 | 7.8 | 2 | — | 47 | 77 |
| 3.9 | 1.4 | 56 | 10 | 24.5 | 16.5 | 2 | — | 116 | 61 |
| | 2.5 | 73 | 16 | 33.0 | 19.5 | 3 | — | 140 | 57 |
| | 2 | 103 | 14 | — | 22.8 | 4 | <5 mg/l | 166 | 48 |

1 TMAOH = tetramethylammonium hydroxide

2 No evolution of chlorine gas was observed.

In a similar experiment using a smaller three compartment cell (compartment size: 1.5l; membrane surface: 1.1 $dm^2$), the concentration of zinc in the produced tetramethylammonium hydroxide was 11 mg/l.

TABLE 3

Electrolysis of Tetrapropylammonium bromide using an iron anode

| Time (hours) | Current (Amps) | Ampere hours | Temperature (°C.) | Cathode Compartment 1 TPAOH (% w/w) | Cathode Compartment $Cl^-$ (mg/l) | Cathode Compartment $Na^+$ (mg/l) | Cathode Compartment $K^+$ (mg/kg) | Anode Compartment $Cl^-$ (% m/m) | Anode Compartment $Br^-$ (% m/m) | cumulative efficiency |
|---|---|---|---|---|---|---|---|---|---|---|
| 0 | 1.0 | 0 | 32 | 0.4 | | 0.3 | 0.1 | | | |
| 45 | 1.9 | 60.8 | 33 | 1.1 | 0.5 | 0.3 | 0.1 | 0.08 | 1.2 | 22.1 |
| 333 | 9.2 | 1515 | 51.4 | 18.3 | 0.4 | 1.9 | 2.8 | 2.6 | 2.0 | 21.4 |
| 380 | 9.0 | 904 | 52.1 | 21.8 | 5 | 1.8 | 3.1 | 5.8 | 11.1 | 20.8 |
| 405 | 9.0 | 2115 | 50.0 | 23.2 | 1 | 2.4 | 3.4 | 6.9 | 11.4 | 20.2 |
| 435 | 9.0 | 2387 | 50.0 | 25.2 | 4 | 2.3 | 3.3 | 8.7 | 12.0 | 19.7 |

1 TPAOH = tetrapropylammonium hydroxide

TABLE 4

Electrolysis of Tetramethylammonium chloride using a copper anode

| 2 Time (hours) | Current (Amps) | Ampere hours | Voltage (volts) | Cathode Compartment Temperature (°C.) | Cathode Compartment 1 TMAOH (% w/w) | $Cl^-$ (Mg/l) | cumulative 1 TMAOH production (g) | cumulative efficiency (%) |
|---|---|---|---|---|---|---|---|---|
| — | 3 | 0 | 12.5 | 25.9 | 0.2 | 2 | 0 | — |
| — | 6 | 11 | 12 | 33.3 | 0.5 | — | 34 | 93 |
| — | 1 | 197 | 7.5 | 38.4 | 5.8 | 7 | 585 | 92 |
| — | 9 | 294 | 12.0 | 39.5 | 8.8 | — | 901 | 94 |
| — | 3 | 459 | 7.0 | 39 | 13.5 | — | 1400 | 92 |
| — | 13.5 | 665 | 11 | 39.4 | 17.1 | — | 1786 | 80 |

1 TMAOH = tetramethylammonium hydroxide
2 In this experiment, time was not recorded; instead ampere hours were measured directly

TABLE 5

Electrolysis of Tetraethylammonium bromide using a platinum anode

| Time (hours) | Current (Amps) | Ampere hours | Temperature (°C.) | Cathode Compartment 1 TEAOH (% w/w) | Cathode Compartment $Cl^-$ (mg/l) | $Na^+$ (mg/l) | $K^+$ (mg/kg) | Anode Compartment $Cl^-$ (% m/m) | Anode Compartment $Br^+$ (% m/m) | cumulative efficiency |
|---|---|---|---|---|---|---|---|---|---|---|
| 0 | 1.5 | 0 | 17 | | | | | not determined | | |
| 93 | 4.2 | | 51 | 16.0 | 34 | 0.7 | 0.1 | | | 51.3 |
| 119 | 5.8 | 19762 | 52 | 23.2 | 26 | 1.0 | 0.2 | | | 48.2 |
| 143 | 6.0 | 29650 | 61 | 28.6 | 20 | | | | | 44.3 |
| 163 | 4.0 | 37267 | 51 | 31.6 | 20 | 1.1 | 0.3 | | | 43.1 |

1 TEAOH = tetraethylammonium hydroxide

We claim:

1. A process for the preparation of a quaternary ammonium hydroxide, which process comprises electrolysing a quaternary ammonium halide in an electrolysis cell having an anode and a cathode, said cell being divided into compartments by at least an anion exchange membrane, and wherein said anode is comprises of a material selected from the group consisting of iron, nickel, zinc, molybdenum and manganese.

2. The process of claim 1 wherein said quaternary ammonium halide is a tetraalkylammonium halide.

3. The process of claim 2 wherein said alkyl groups of said tetraalkylammonium halide are the same and are selected from the group consisting of methyl, ethyl, n-propyl, and n-butyl.

4. The process of claim 1 wherein said halide is selected from the group consisting of a chloride and a bromide.

5. The process of claim 1 wherein said electrolysis is conducted at a temperature in the range of from 20° to 130° C.

6. The process of claim 1 wherein the quaternary ammonium hydroxide is produced in a compartment of said electrolysis cell having a pH about 11.

7. The process of claim 6 wherein the pH in compartments in said electrolysis cell other than in which said quaternary ammonium hydroxide is produced is below 5.

8. The process of claim 1 wherein said electrolysis cell is divided into multiple compartments by at least one cation exchange membrane.

9. The process of claim 8 wherein said electrolysis cell is divided into multiple compartments by an anion exchange membrane and a cation exchange membrane.

10. The process of claim 8, wherein said electrolysis cell includes at least one anion exchange membrane, and an inert cathode.

11. The process of claim 1 wherein said cathode is comprised of an inert material.

12. The process of claim 1 wherein said anode is comprised of iron.

13. The process of claim 1 wherein said anode is comprised of zinc.

14. The process of claim 1 wherein said anode is comprised of molybdenum.

15. The process of claim 1 wherein said anode is comprised of manganese.

* * * * *